US007316642B2

(12) United States Patent
Martelli

(10) Patent No.: US 7,316,642 B2
(45) Date of Patent: Jan. 8, 2008

(54) APPARATUS FOR FORMING CONTAINERS

(75) Inventor: Antonio Martelli, Bologna (IT)

(73) Assignee: O.A.M. S.p.A., Pianoro-Frazione Rastignano (IT)

( * ) Notice: Subject to any disclaimer, the term of this patent is extended or adjusted under 35 U.S.C. 154(b) by 20 days.

(21) Appl. No.: 10/544,824

(22) PCT Filed: Feb. 24, 2004

(86) PCT No.: PCT/EP2004/001813

§ 371 (c)(1),
(2), (4) Date: Aug. 8, 2005

(87) PCT Pub. No.: WO2004/076286

PCT Pub. Date: Sep. 10, 2004

(65) Prior Publication Data

US 2006/0073957 A1 Apr. 6, 2006

(30) Foreign Application Priority Data

Feb. 25, 2003 (IT) ..... B02003A0092

(51) Int. Cl.
*B31B 1/78* (2006.01)

(52) U.S. Cl. ..... 493/309; 493/318; 493/319; 53/564

(58) Field of Classification Search ..... 493/123–127, 493/309–313, 315, 316, 55, 318, 319; 53/573, 53/564, 457, 458, 468
See application file for complete search history.

(56) References Cited

U.S. PATENT DOCUMENTS

| | | | | |
|---|---|---|---|---|
| 4,389,205 | A | 6/1983 | Righi | |
| 5,473,868 | A | 12/1995 | Martelli | |
| 5,813,965 | A * | 9/1998 | Mitchell et al. | 493/315 |
| 6,699,165 | B1 * | 3/2004 | Krieger et al. | 493/122 |

* cited by examiner

*Primary Examiner*—Hemant M. Desai
(74) *Attorney, Agent, or Firm*—Modiano & Associati; Albert Josif; Daniel J. O'Byrne

(57) ABSTRACT

An apparatus for forming containers fed with their side walls arranged in a flattened tubular configuration, comprising a device for opening the containers that is associated with abutment-retention elements for the abutment and retention of the containers in the open configuration and with transfer elements for transferring the open containers into respective variable-geometry receptacles of a conveyance line, the receptacles being suitable to move from a first open configuration for receiving the containers to a second closed configuration for conveying the containers to a subsequent treatment station.

15 Claims, 5 Drawing Sheets

APPARATUS FOR FORMING CONTAINERS

This application is a 371 of PCT/EP04/01813 filed on Feb. 24, 2004.

The present invention relates to an apparatus for forming containers fed with their side walls arranged in a flattened tubular configuration.

BACKGROUND OF THE INVENTION

In the field of the packaging of consumer products of various kinds there is an increasing use of substantially box-like containers made of a lightweight material such as cardboard or synthetic material, specifically suitable to protect the product and to give it specific aesthetic and consumer presentation qualities.

Packaging occurs, preferably in an automated manner, on machines that insert the product in a respective container that is provided appropriately. The containers are usually stored, for example in a stack, so that their side walls are arranged in a substantially flattened tubular configuration, so as to achieve minimum space occupation.

In order to perform automated insertion of the products in the respective containers taken in succession from the magazine, each container must be opened out, i.e. its side walls must be appropriately spaced apart and lifted. Opening is generally performed by inserting an appropriately provided element between the walls of the container so as to lift them at a preset angle; the open containers must then be conveyed to a product insertion station.

Currently, the containers, after being opened, are gripped by an appropriately provided transfer device equipped with supporting elements that are arranged so as to form a sort of comb, and are stored in respective receptacles provided on a conveyance line, for example of the chain type, that is suitable to convey the open containers to the next treatment station.

The transfer device described above is not free from drawbacks.

It has in fact considerable limitations, the foremost being linked to the quality level of the formed containers: a considerable percentage of the open containers is in fact often affected by surface damage, mainly due to the fact that the containers, in order to be inserted in the respective receptacles, are subjected to a certain forcing: this can also cause incorrect positioning of the containers in the receptacles, with consequent jamming and halting of the production line.

Secondly, the device for transferring the open containers is characterized by production rates that can be increased in order to meet the ever increasing demand for higher efficiency of the machine.

SUMMARY OF THE INVENTION

The aim of the present invention is to obviate the above-cited drawbacks, by providing an apparatus that allows to open containers with side walls arranged in a flattened tubular configuration and to deposit them effectively on a conveyance line without causing damage to them by forcing.

Within this aim, an object of the present invention is to provide an apparatus that has no functional limitations and hindrances, such as for example incorrect placement or jamming of the containers in the respective receptacles of the conveyance line.

Another object of the present invention is to provide an apparatus that is suitable to operate efficiently at high production rates.

Another object of the present invention is to provide an apparatus that is simple, relatively easy to provide in practice, safe in use, effective in operation, and has a relatively low cost.

This aim and these and other objects that will become better apparent hereinafter are achieved by an apparatus for forming containers fed with their side walls arranged in a flattened tubular configuration, characterized in that it comprises a device for opening the containers that is associated with means for the abutment and retention of the containers in the open configuration and with means for transferring the open containers into respective variable-geometry receptacles of a conveyance line, said receptacles being suitable to move from a first open configuration for receiving the containers to a second closed configuration for conveying the containers to a subsequent treatment station.

BRIEF DESCRIPTION OF THE DRAWINGS

Further characteristics and advantages of the present invention will become better apparent from the following detailed description of a preferred but not exclusive embodiment of an apparatus for forming containers fed with their side walls arranged in a flattened tubular configuration according to the invention, illustrated by way of non-limiting example in the accompanying drawings, wherein.

DESCRIPTION OF THE PREFERRED EMBODIMENTS

In the embodiments that follow, individual characteristics, given in relation to specific examples, may actually be interchanged with other different characteristics that exist in other embodiments.

Figure 1:
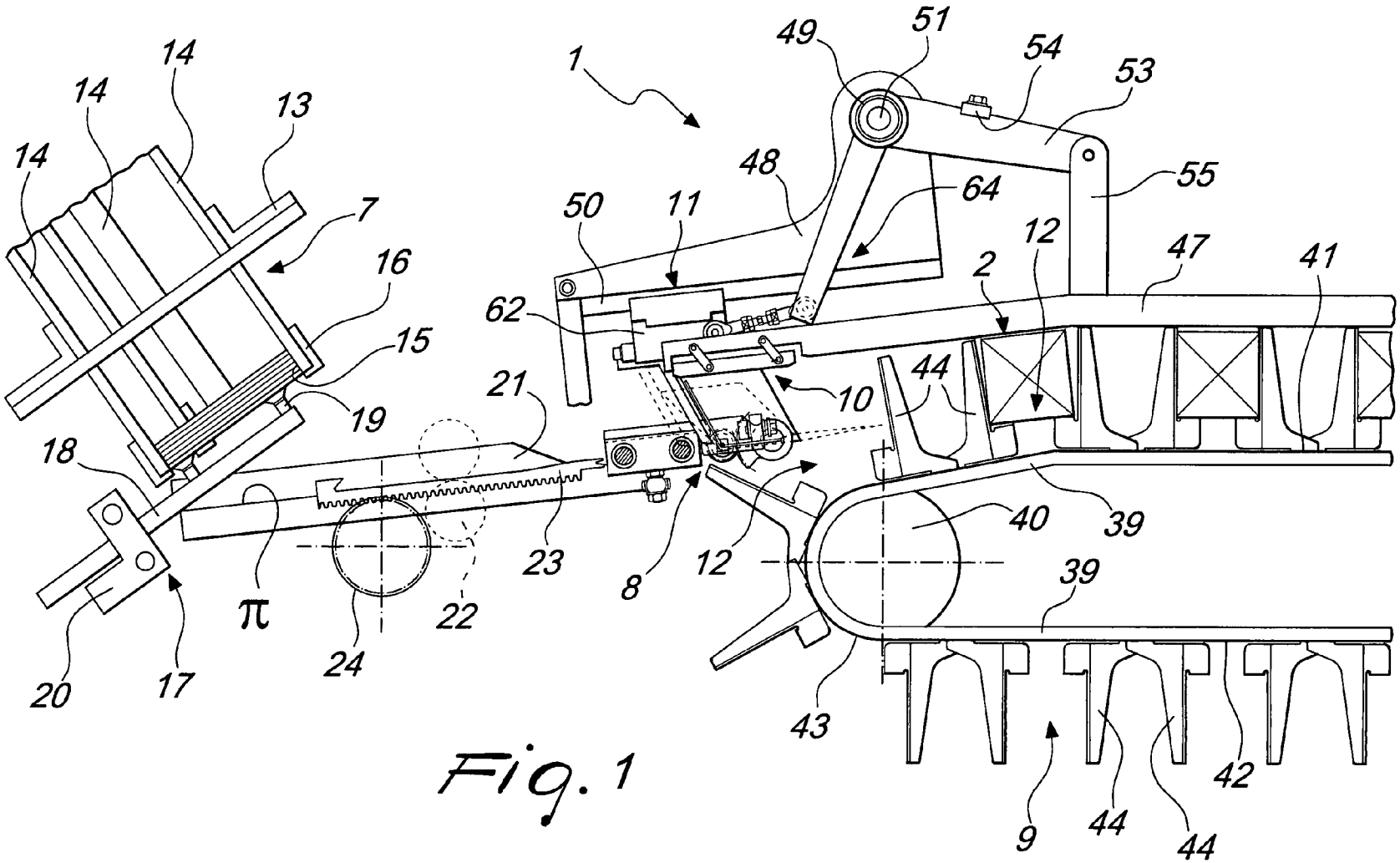
FIG. 1 is a front view of the apparatus according to the invention in a step for forming the containers.
Figure 2:
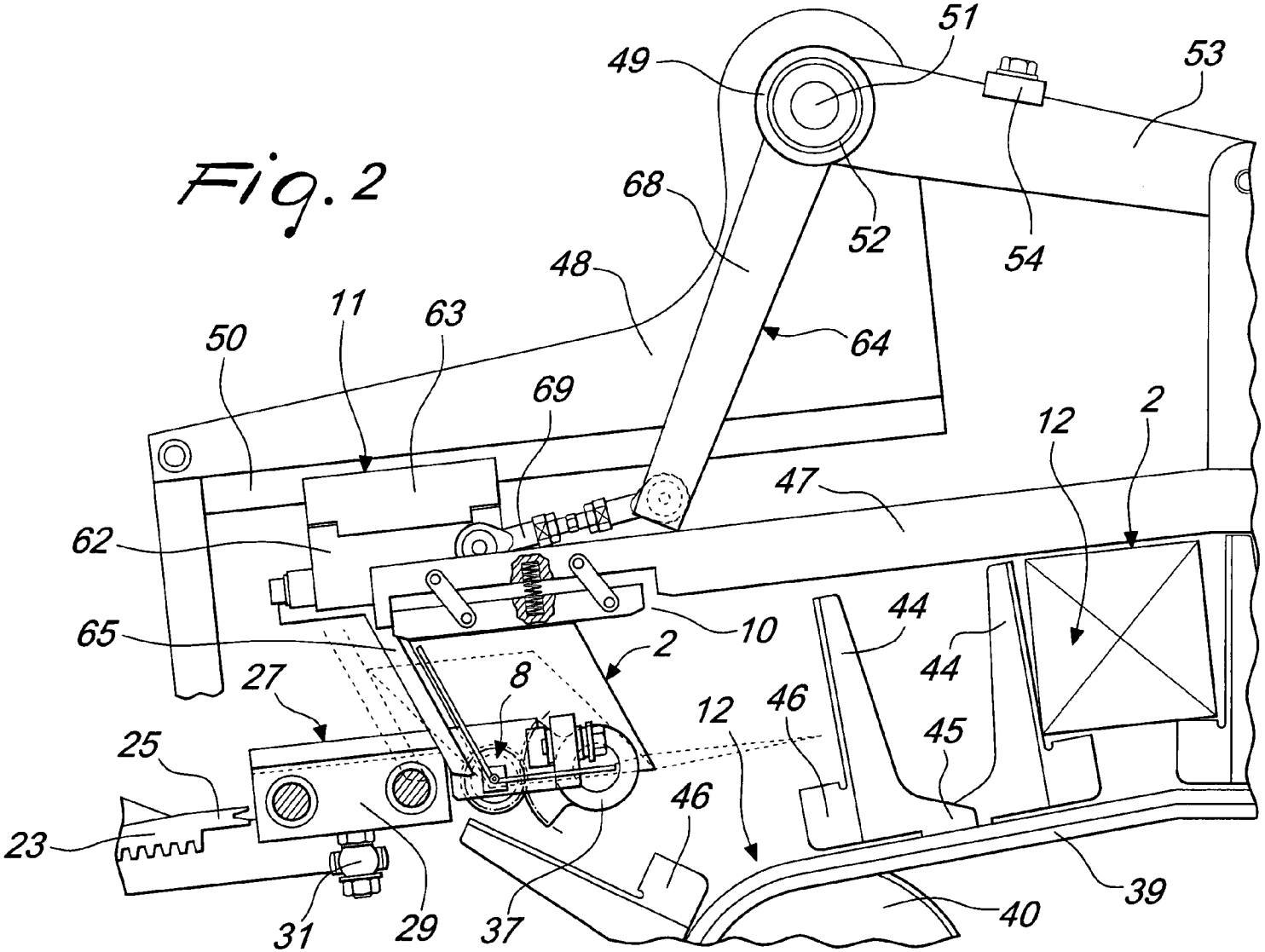
FIG. 2 is a detail side view of the apparatus of FIG. 1.
Figure 3:
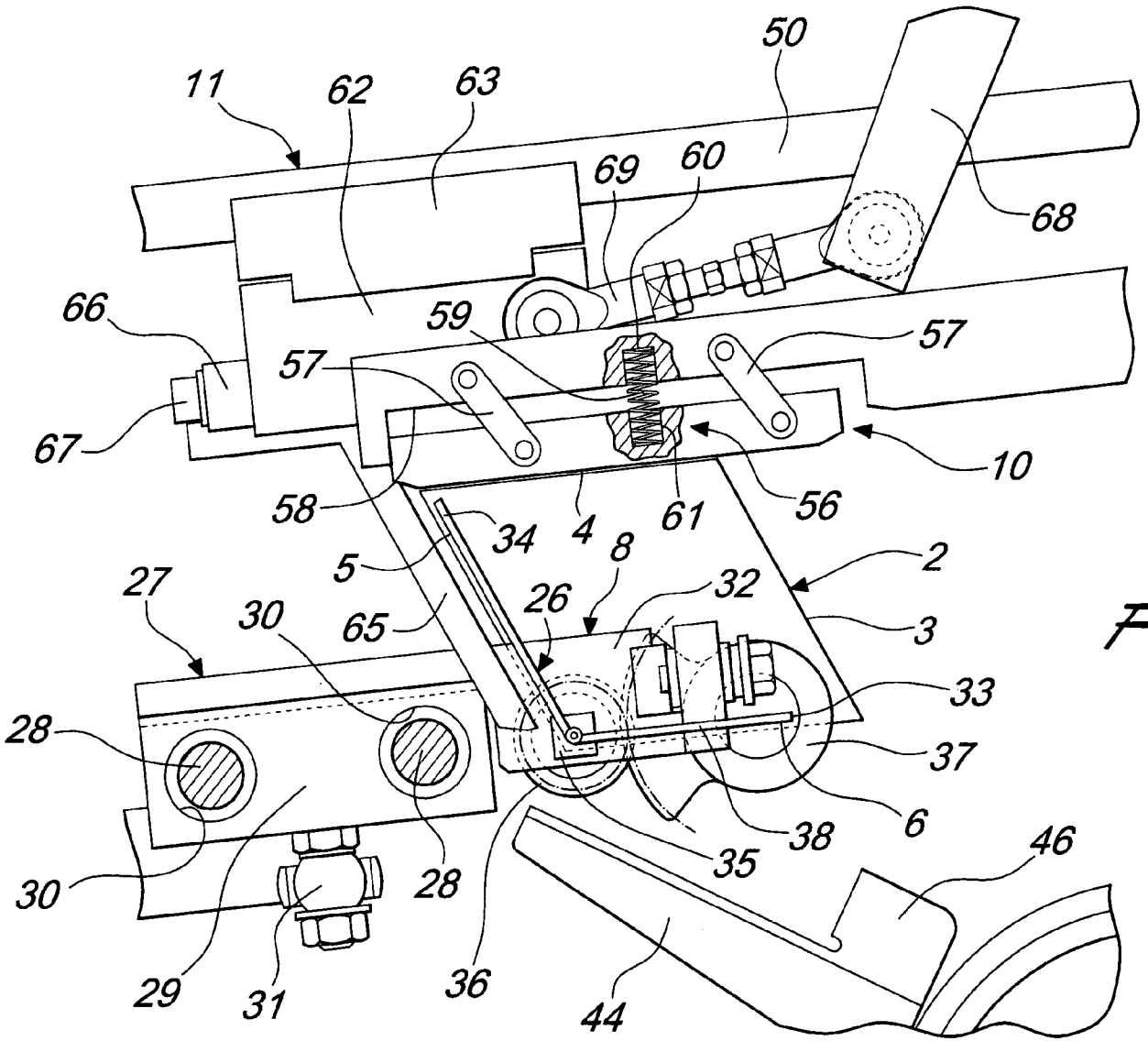
FIG. 3 is a further enlarged-scale side view of the apparatus of FIGS. 1 and 2.

With reference to FIGS. 1 and 2, the reference numeral 1 generally designates an apparatus according to the invention for forming containers 2 fed with their side walls arranged in a flattened tubular configuration.

The containers 2 are of the type with a substantially box-like configuration, formed by side walls 3, 4, 5, 6; the containers are made of a material such as cardboard or synthetic material.

The apparatus is generally inserted in a line for packaging consumer products in the containers 2; such products can be of various kinds and can have the most disparate formats. Upstream of the apparatus a sort of magazine 7 is provided, in which the containers 2 are packed or stacked one on top of the other in a substantially flattened tubular configuration.

The apparatus comprises, according to the invention, an opening device 8 that is suitable to make each one of the containers 2 assume the unfolded tubular configuration that is ideal for inserting products of various kinds therein; the opening device 8 leads to a line 9 for conveying the open containers, by means of which the containers are conveyed in succession preferably toward a successive operating station, such as for example a product insertion station. The opening device 8 is associated with means 10 for the abutment and stable retention of the containers in the open configuration; such means 10 are suitable to prevent the containers from collapsing spontaneously and resuming the flattened configuration; the device 8 is further associated with means 11 for transferring the open containers 2 in respective variable-geometry receptacles 12 provided along the conveyance line 9.

Each one of the receptacles 12 is suitable to move from a first open configuration for receiving the unfolded containers to a second closed configuration for conveying the containers along the line 9 toward a subsequent treatment station.

The magazine 7 of the containers 2 in the flattened configuration is substantially shaped like a hopper, which is inclined by a suitable angle with respect to the vertical, and comprises a support 13 that is rigidly coupled to the footing of the apparatus and to which side walls 14 are fixed; such side walls 14 are mutually opposite in pairs and form a sort of channel for the descent of the containers that leads to an outlet 15. Elements 16 for selectively stopping the containers 2 are provided in association with the outlet 15 and allow to extract in succession the container that occupies the lowest position in the stack while retaining the overlying ones.

An element 17 for removing the containers 2 in the flattened configuration is located at the outlet 15 of the magazine 7: it is constituted for example by an arm 18 that is provided with one or more pairs of suckers 19 and is adjustably fixed on a motorized rotating support 20 that is suitable to produce a reciprocating motion characterized by a preset angular stroke. The arm 18 is actuated so as to rotate between an upper angular position, in which the suckers 19 adhere to the container 2 that occupies the lowest position of the stack, and a lower angular position, in which the arm 18 is arranged below a surface Π for the deposition and advancement of the containers 2 that is formed by parallel sides 21: two rollers 22, in mutual contact along a generatrix at the surface Π, allow to print on the side walls 3, 4, 5, 6 of the containers.

The parallel sides 21 determine the container feed direction, which in the specific case is slightly inclined with respect to the horizontal. The parallel sides 21 are associated with a pusher 23 for pushing the containers 2 in the feed direction, i.e., toward the opening device 8. The pusher 23 is preferably constituted by a rack that meshes with an actuation pinion 24; the pusher 23 has, at its front end, an extension 25 that is substantially fork-shaped and is suitable to produce the translational motion of each container 2 arranged on the advancement surface Π in the feed direction of the opening device 8.

The opening device 8 comprises a laminar element 26 that is suitable to penetrate between the side walls 3, 4, 5, 6 of each container 2 in the flattened configuration so as to raise the walls 3, 4, 5 in order to arrange them in the open configuration; the laminar element 26 is associated with means 27 for translational motion in a direction that is substantially perpendicular to the advancement direction of the containers 2. The translational motion means 27 comprise two parallel cylindrical rods 28 whose axes are perpendicular to the advancement direction of the containers 2; a slider 29 is coupled so that it can slide along said rods, is provided with two circular holes 30 for engaging the rods 28, and is associated with a lever system 31; a bracket 32 is fixed to the slider 29, preferably by means of a side-fit coupling, and the laminar element 26 in turn is connected to said bracket for example by means of screws and in an adjustable manner.

The laminar element 26 in this manner can be actuated so as to perform a translational motion that is parallel to the rods 28 and therefore at right angles to the advancement direction of the containers 2 from a retracted position to an extended position for insertion between the side walls 3, 4, 5, 6 of the container 2 in the flattened tubular configuration.

The laminar element 26 is constituted by a lower plate 33 and by an upper plate 34, which are thin and are mutually pivoted about an actuation shaft 35 on which a gear 36 is keyed; such gear meshes with a toothed sector 37, which is associated with motion transmission means, which are not shown in the figures since they are fully intuitive.

Preferably, the lower plate 33 has a longitudinally elongated shape and its front side 38 is beveled and slightly inclined so as to facilitate the insertion of the laminar element 26 in the containers 2 in the flattened configuration.

In its translational motion at right angles to the advancement direction of the containers 2, the lower plate 33 of the laminar element 26 lies substantially on the advancement surface Π of the containers; the upper plate 34 is actuated by the shaft 35 so as to rotate, in the extended position of the laminar element 26, from an angular position for insertion in the container 2, in which it is substantially superimposed on the lower plate 33, to an angular position that is inclined with respect to said lower plate. The rotation of the upper plate 34 with respect to the lower plate 33 allows to lift the side walls 3, 4, 5 of the container at a preset angle in the open configuration.

The conveyance line 9 is preferably constituted by two parallel chains 39 that are closed in a loop and wind around respective pairs of coaxial actuation and guiding wheels 40, so that each one forms, in its own motion, an upper portion 41 and a lower portion 42 spaced by a substantially circular arc-like portion 43. Along the chains 39 a distribution of pairs of tooth-shaped partitions 44 that are mutually opposite in pairs is provided; adjacent and opposite pairs of partitions 44 form the variable geometry-receptacles 12 for the open containers 2. In the motion of each chain 39 about the respective wheel 40, the curvature of the circular arc-like portion 43 produces the transition of the receptacles 12 formed by the partitions 44 from the first open configuration (in which the partitions 44 are mutually divaricated and diverge), which is suitable to receive the open containers, to a second closed configuration (in which the partitions 44 are substantially parallel), in which the containers 2 are firmly retained along the walls 3, 5 and conveyed to a subsequent station. Each one of the partitions 44 has a lower portion that forms on one side a protrusion 45 for abutment and fixing on the respective chain 39 and, on the other side, a sort of tooth 46 that forms a flat contact surface for the lower side wall 6 of the open container 2.

One of the pairs of wheels 40 around which the chains 39 wind is supported so that it can rotate in the footing of the apparatus proximate to the opening device 8, the abutment and retention means 10, and the means 11 for transferring the containers 2. In particular, the axis of the pairs of wheels 40 is arranged substantially below the pivoting axis of the lower plate 33 and the upper plate 34 of the laminar element 26.

The conveyance line 9 is associated with at least one pair of elongated strips 47 for providing upper contrast to the motion of the open containers 2. A contoured plate 48 that is rigidly coupled to the footing of the apparatus forms a sleeve 49 in an upper region and a straight guide 50 in a lower region. An actuation axis 51 is rotatably supported within the sleeve 49 and has a free end at which two bars 53 are keyed in respective end portions (and locked by means of a cylindrical clamp 52); such bars are perpendicular to the axis, are connected by a reinforcement cross-member 54, and are articulated at their opposite ends to rods 55 that are rigidly coupled respectively with the two upper contrast strips 47. The manual rotation of the bars 53 during the fine-tuning of the apparatus allows to raise and lower the contrast strips 47 in order to perform suitable adjustments correlated to the size variations of the containers 2 or in order to perform maintenance (for example in case of jamming due to a container positioned improperly in the respective receptacle 12, or for other causes of incorrect operation).

The means 10 for the abutment and retention of the containers 2 are constituted by at least one oscillating element 56, which is arranged substantially above the opening device 8 and in particular above the laminar element 26. The oscillating element 56 can move from an upper position, in which it is raised in order to allow the rotation of the upper plate 34 of the laminar element 26 together with the side walls 3, 4, 5 of the container 2, to a lower position, in which it is substantially engaged on the upper side wall 4: in this manner, when the laminar element 26 is in the retracted position, spontaneous reclosure of the side walls 3, 4, 5 of the container is prevented, and the container is retained, together with the transfer means 11, in the squared configuration in order to be then transferred onto the conveyance line 9.

The oscillating element 56 has an elongated parallelepipedal configuration, with beveled front and rear edges, is arranged substantially parallel to the advancement surface Π of the containers 2, and is connected to fixed portions of the apparatus: advantageously, two parallel oscillating elements 56 are provided that are connected, by means of respective pairs of articulated rockers 57, at their respective ends, to the upper contrast strips 47 of the conveyance line 9, in which suitable contoured recesses 58 are provided for this purpose: in this manner, it is possible to provide a sort of articulated parallelogram. Each one of the two oscillating elements 56 is suitable to abut respectively at the ends of the upper side wall 4 of each container, so as to distribute and balance the retaining action applied thereto. Stable grip of each oscillating element 56 on the container 2 is achieved by providing elastic means 59 that are interposed between the element 56 and the respective upper contrast strip 47.

The elastic means 59 are preferably constituted by a helical cylindrical spring, in which a first end is inserted in abutment within a seat 60 that is provided in the strip and a second end abuts within a dead hole 61 provided in the upper face of the oscillating element 56.

The means 11 for transferring the open containers 2, which cooperate with the abutment and retention means 10 in retaining the containers, comprise a carriage 62 that is engaged so that it can slide, with its upper portion 63, along the guide 50 provided at the base of the plate 48; the carriage 62 is actuated so as to perform a reciprocating translational motion along the guide 50 by a crank system 64 that is controlled by elements of a known kind, which are not shown in the drawings. The carriage 62 is provided with two appendages 65 that extend downward and are inclined by a preset angle with respect to the advancement surface Π of the containers 2. Preferably, the appendages 65 are connected, so that they are adjustable by means of screws, to an elongated support 66, which in turn is fixed to the carriage 62 by means of an additional screw 67.

The crank system 64 for actuating the carriage 62 comprises a crank 68 that is keyed to the axis 51, which is turned with an alternating rotary motion about its own axis; at its free end, the crank 68 is articulated to the first end of a traction element 69 that has an adjustable center distance and in which the second end is pivoted to a side of the carriage 62. The carriage 62, driven by the crank 68, performs an advancement stroke, in which it pushes the unfolded container 2 into a receptacle 12 in the open configuration, and a retraction stroke, in order to reposition itself at the laminar element 26 in order to perform the subsequent opening operation. The inclination at a preset and appropriate angle given to the appendages 65 of the carriage 62 with respect to the advancement surface Π of the containers 2 allows, during the opening of said containers, to provide a rear abutment of the side wall 5 of the container raised by the upper strip 34 of the laminar element 26 and, once opening is complete, allows to push the unfolded container 2, kept in the correct configuration by the oscillating element 56, into a receptacle 12 in the open configuration.

The operation of the apparatus according to the invention is as follows.

The containers 2, in the flattened tubular configuration, are taken from the magazine 7 and are made to advance in succession by the action of the pusher 23, which is controlled by the motion of the corresponding toothed pinion 37. Each container 2 therefore arrives at the opening device 8: the advancement of the slider 29 along the rods 28 allows the translational motion, at right angles to the container advancement direction, of the laminar element 26, which is inserted fully between the side walls 3, 4, 5, 6 of the container to be opened. At this point, the actuated rotation of the toothed sector 37, transmitted to the gear 36, allows to achieve a consequent rotation of the shaft 33. This produces the rotation, through a preset angle, of the upper strip 34, accordingly lifting the side walls 3, 4, 5 of the container, which assume the open configuration (in FIG. 2, discontinuous lines illustrate successive configurations of the container during opening, and the appendages 65 are shown in their rear stroke limit position).

The lifting of the side walls 3, 4, 5 of the container causes by interference a substantially upward action, in particular of the walls 4 and 5, on the oscillating elements 56, which are initially in the lower position and rise elastically into the upper position, contrasted by the respective helical springs 59. The appropriate choice of the rotation angle of the upper strip 34 of the laminar element 26 allows to raise the side walls 3, 4, 5 of the container until an unfolded configuration is achieved which, thanks to the higher elastic action applied by the oscillating elements 56 and of the rear abutment of the appendages 65 of the carriage 62, is substantially stable (once the laminar element 26 has been extracted by reverse motion of the slider 29), since the container 2 is prevented from collapsing.

The carriage 62 at this point is moved by the crank system 64 so as to perform a translational motion toward the conveyance line 9, so as to push the squared container 2 into a respective receptacle 12, sliding with the upper side wall 4 along the oscillating elements 56.

The partitions 44 of the conveyance line 9, by passing over the actuation wheels 40 of the chain 39 (at the circular arc-like portion 43), initially undergo a mutually divaricating motion that opens the receptacle 12, which accordingly assumes the first open configuration for receiving the containers, which is followed by a mutual relative approach motion that causes their reclosure in the second configuration for conveyance of the containers 2. Such approach motion, appropriately in step with the advancement stroke of the carriage 62, allows the open container 2 to penetrate between the partitions 44 and rest with the lower side wall 6 on the teeth 46; the reclosure of the partitions 44 in the second configuration accordingly produces the stable and safe retention of the unfolded container 2 and its conveyance toward a subsequent treatment station.

It has thus been shown that the invention achieves the intended aim and objects.

The invention thus conceived is susceptible of numerous modifications and variations, all of which are within the scope of the appended claims. In particular, it is noted that the apparatus can be used effectively to form containers of any shape or size.

Figure 4:
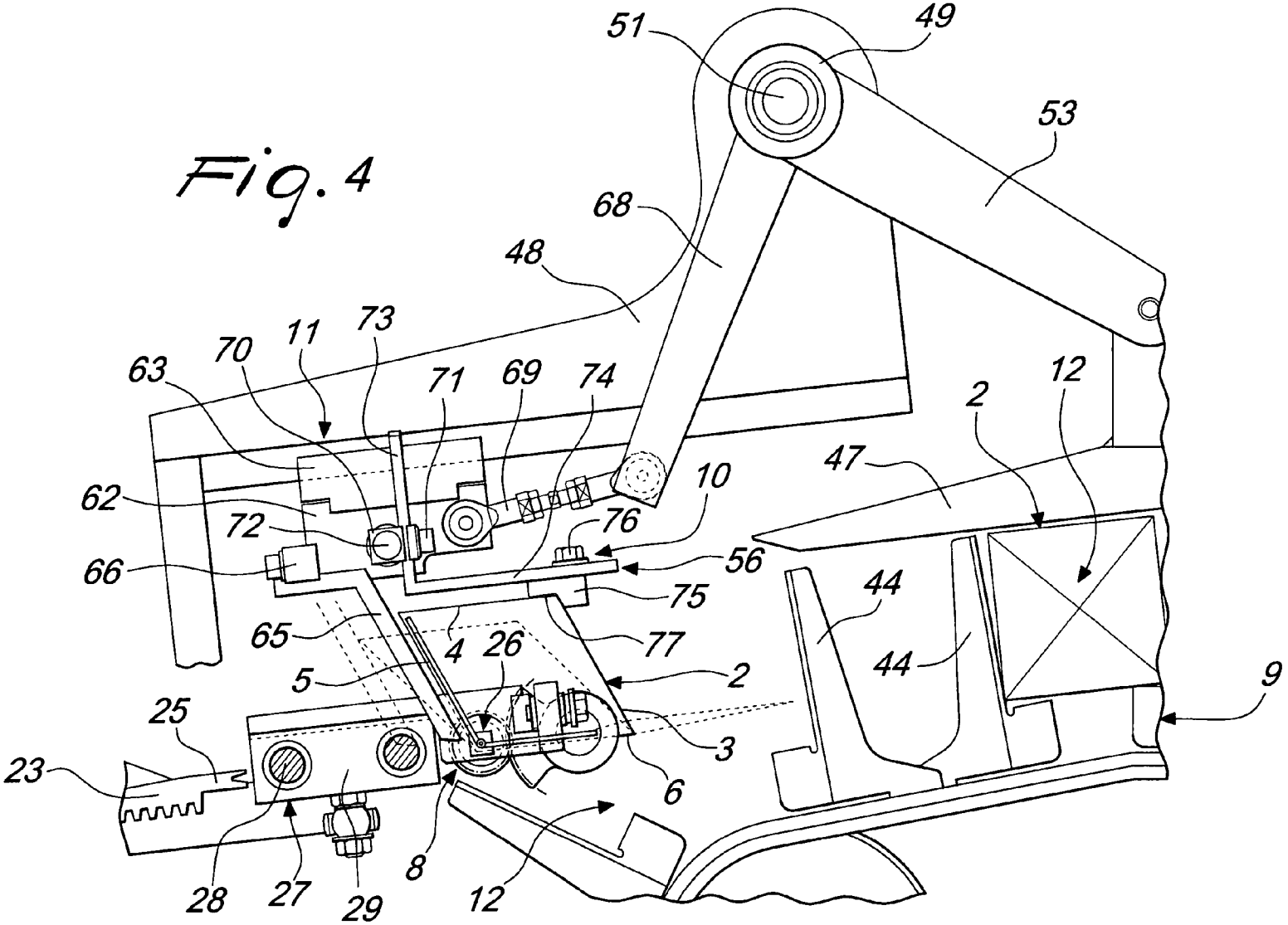
FIG. 4 is a detail side view of an alternative embodiment of the apparatus according to the invention.
Figure 5:
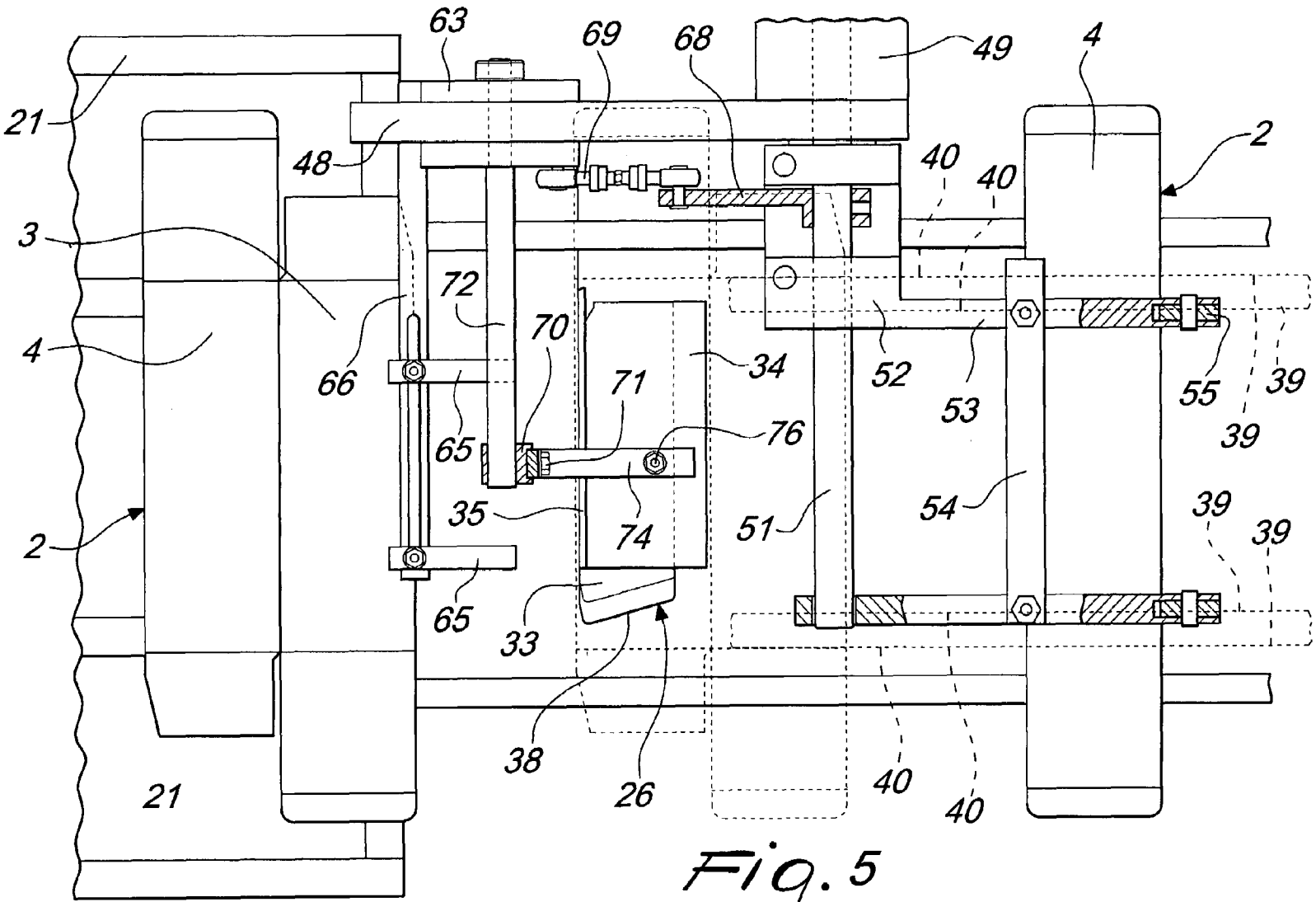
FIG. 5 is a detail plan view of the apparatus in the embodiment of FIG. 4.

In an alternative embodiment of the apparatus according to the invention, shown in FIGS. 4 and 5 (in which the elements that have already been described have been designated by the same reference numerals), the oscillating element 56 is rigidly coupled to the means 11 for transferring the containers in the open configuration. The oscillating element 56 is rigidly connected, for example by means of a clamp 70 locked by a screw 71, to a central shaft 72 that is supported so that it can rotate substantially at the center of the side of the carriage 62: the shaft 72 is actuated so as to rotate with a reciprocating motion about its own axis in step with the translational and rotational motion of the laminar element 26, so as to move the oscillating element 56 from a lower angular position to an upper angular position during the upward motion of the side walls 3, 4, 5 of the container 2 in order to prevent unwanted and damaging interference contacts, and then from the upper angular position to the lower angular position in order to retain the container in the open configuration.

The oscillating element 56 is substantially L-shaped and is constituted by a first segment 73, which is coupled adjustably (according to the dimensions of the containers) to the clamp 70 that is keyed to the shaft 72, and by a second segment 74, which is perpendicular to the first segment 73 and is provided at its free end with a contoured tooth 75 that is fixed by means of a screw 76. The contoured tooth 75 has a recess 77 whose geometry is complementary to the edge formed by the side walls 3 and 4 of the container, so as to constitute an effective abutment against the spontaneous reclosure of the walls and so as to retain the container 2 in cooperation with the appendages 65 of the carriage after the exit of the laminar element 26.

The abutment and retention means 10 and the transfer means 11 associated with the opening device 8 allow to deposit the unfolded containers 2 on the conveyance line 9 without causing damage due to forcing during the insertion of the containers in the receptacles 12; the apparatus is further capable of operating at high production rates and efficiently, simply and without drawbacks of various kinds.

All the details may be replaced with other technically equivalent ones.

In practice, the materials used, as well as the shapes and dimensions, may be any according to requirements and to the state of the art without thereby abandoning the protective scope of the appended claims.

The disclosures in Italian Patent Application No. BO2003A000092 from which this application claims priority are incorporated herein by reference.

What is claimed is:

1. An apparatus for forming containers fed with side walls thereof arranged in a flattened tubular configuration, comprising: a conveyance line; a device for opening containers that comprises a laminar element constituted by an upper plate and by a lower plate, said upper and lower plates being thin and mutually pivoted along respective sides about a longitudinal axis that is substantially perpendicular to an advancement direction of the containers, said laminar element being actuatable for performing a translational motion, for each cycle for opening the containers, parallel to said longitudinal axis from a retracted position to an extended position for insertion between the side walls of the container in the flattened tubular configuration, said lower plate being arranged substantially on an advancement surface for the containers, said upper plate being actuatable for rotation about said longitudinal axis and with said laminar element in said extended position, from an angular position for insertion in the container, in which the upper plate is substantially superimposed on said lower plate, to an angular position that is inclined with respect to said lower plate, so as to raise said side walls at a preset angle in said squared configuration; retention-abutment means for abutment and retention of the containers in an open configuration which comprise at least one oscillating element that is arranged substantially above said laminar element and can move from an upper position, in which the oscillating element is raised in order to allow the rotation of said upper plate together with said side walls of the container, to a lower position, in which said at least one oscillating element substantially acts on the container so as to retain the container in said open configuration, preventing spontaneous reclosure thereof in said flattened tubular configuration; and transfer means for transferring open containers into respective variable-geometry receptacles of the conveyance line, said opening device, retention-abutment means and transfer means being operatively associated and said receptacles being movable from a first open configuration for receiving the containers to a second closed configuration for conveying the containers to a subsequent treatment station.

2. The apparatus of claim 1, wherein said receptacles are formed by pairs of partitions that are arranged mutually opposite in pairs and are distributed so as to be rigidly coupled along at least one pair of chains that are mutually parallel and closed in a loop and are wound around respective wheels having a suitable radius so that each one forms at least one upper portion and at least one lower portion spaced by a substantially circular arc-like portion, said opening device, said abutment and retention means and said transfer means being located at said circular arc-like portions so that the motion of said chains on said wheels, at said circular arc-like portion, produces transition of each one of said variable-geometry receptacles from said first open configuration for receiving the containers, in which said partitions of each pair substantially diverge from each other, to said second closed configuration for conveying the containers inserted by said transfer means, said partitions being substantially mutually parallel in said closed configuration so as to firmly retain said containers along said side walls.

3. The apparatus of claim 1, wherein said at least one oscillating element is shaped like an elongated parallelepiped, is arranged substantially parallel to said advancement surface of the containers, and is articulated by way of at least one pair of rockers to fixed parts of the apparatus so as to provide an articulated parallelogram, elastic means that act on said at least one oscillating element being further provided which are suitable to keep said at least one oscillating element stably in said lower position in order to apply a retaining action to the upper side wall of the container in said open configuration.

4. The apparatus of claim 3, wherein said elastic means are constituted by a helical cylindrical spring in which a first end and a second end thereof are inserted in abutment respectively in a seat provided in said fixed parts of the apparatus and in a dead hole provided in an upper face of said at least one oscillating element.

5. The apparatus of claim 1, wherein said at least one oscillating element is substantially L-shaped and is constituted by a first segment, which is rigidly coupled to a rotary actuation shaft for turning said at least one oscillating element from said upper position to said lower position and vice versa, and by a second segment, which is perpendicular to said first segment and is provided at its end with a contoured tooth for abutment against the edge of the container in said open configuration.

6. The apparatus of claim 5, wherein said actuation shaft for actuation of said at least one oscillating element is supported so that it can rotate in said transfer means for transferring open containers.

7. The apparatus of claim 6, wherein said transfer means for transferring the containers in the open configuration comprise a carriage that can slide along a guide that lies above said opening device and with a crank system for actuating the carriage in a reciprocating manner, said carriage being provided with appendages that extend downward and are inclined at a preset angle with respect to said surface for the advancement of the containers, said appendages being suitable to retain each container, together with said retention and abutment means, in the open configuration, and to push the container into said receptacle.

8. An apparatus for forming containers fed with side walls thereof arranged in a flattened tubular configuration, comprising: a conveyance line; a device for opening containers that comprises a laminar element constituted by an upper plate and by a lower plate, said upper and lower plates being thin and mutually pivoted along respective sides about a longitudinal axis that is substantially perpendicular to an advancement direction of the containers, said lower plate being arranged substantially on an advancement surface for the containers; retention-abutment means for abutment and retention of the containers in an open configuration which comprise at least one oscillating element that is arranged above said laminar element and is movable from an upper position, in which said at least one oscillating element is raised in order to allow rotation of said upper plate together with the side walls of the container, to a lower position, in which said at least one oscillating element acts on the container so as to retain the container in said open configuration, preventing spontaneous redo sure thereof in the flattened tubular configuration; and transfer means for transferring open containers into respective variable-geometry receptacles of the conveyance line, said opening device, retention-abutment means and transfer means being operatively associated and said receptacles being movable from a first open configuration for receiving the containers to a second closed configuration for conveying the containers to a subsequent treatment station.

9. The apparatus of claim 8, further comprising; translational motion means for actuation of said laminar element so as to perform a translational motion, for each cycle for opening the containers, parallel to said longitudinal axis from a retracted position to an extended position for insertion between the side walls of the container in the flattened tubular configuration; and a rotary actuation shaft laying along said longitudinal axis, said upper plate being actuated by said actuation shaft for rotation about said longitudinal axis and with said laminar element in said extended position, from an angular position for insertion in the container, in which the upper plate is substantially superimposed on said lower plate, to an angular position that is inclined with respect to said lower plate, so as to raise said side walls at a preset angle in said squared configuration.

10. The apparatus of claim 9, wherein said at least one oscillating element is substantially L-shaped and is constituted by a first segment, which is rigidly coupled to said rotary actuation shaft for turning said at least one oscillating element from said upper position to said lower position and vice versa, and by a second segment, which is perpendicular to said first segment and is provided at its end with a contoured tooth for abutment against the edge of the container in said open configuration.

11. The apparatus of claim 10, wherein said rotary actuation shaft for actuation of said oscillating element is supported so as to be rotatable in said transfer means for transferring open containers.

12. The apparatus of claim 11, wherein said transfer means for transferring the containers in the open configuration comprise a carriage that is slidable along a guide that lies above said opening device and a crank system for actuating the carriage in a reciprocating manner, said carriage being provided with appendages that extend downward and are inclined at a preset angle with respect to said advancement surface for the containers, said appendages being suitable to retain each container, together with said retention and abutment means, in the open configuration, and to push the container into said receptacle.

13. The apparatus of claim 8, wherein said receptacles are formed by pairs of partitions that are arranged mutually opposite in pairs and are distributed so as to be rigidly coupled along at least one pair of chains that are mutually parallel and closed in a loop and are wound around respective wheels having a suitable radius so that each one forms at least one upper portion and at least one lower portion spaced by a substantially circular arc-like portion, said opening device, said abutment end retention means and said transfer means being located at said circular are-like portions so that the motion of said chains on said wheels, at said circular arc-like portion, produces transition of each one of said variable-geometry receptacles from said first open configuration for receiving the containers, in which said partitions of each pair substantially diverge from each other, to said second closed configuration for conveying the containers inserted by said transfer means, said partitions being substantially mutually parallel in said closed configuration so as to firmly retain said containers along said side walls.

14. The apparatus of claim 13, further comprising: at least one pair of rockers, said at least one oscillating element being shaped like an elongated parallelepiped arranged substantially parallel to said advancement surface of the containers, and articulated by way of said at least one pair of rockers to fixed parts of the apparatus so as to provide an articulated parallelogram; and elastic means that act on said at least one oscillating element for keeping it stably in said, lower position in order to apply a retaining action to an upper side wall of the container in said open configuration.

15. The apparatus of claim 14, wherein said elastic means are constituted by a helical cylindrical spring in which a first end and a second end thereof are inserted in abutment, respectively, in a seat provided in said fixed parts of the apparatus and in a dead hole provided in an upper face of said at least one oscillating element.

* * * * *